US006336310B1

(12) United States Patent
Redmond

(10) Patent No.: US 6,336,310 B1
(45) Date of Patent: Jan. 8, 2002

(54) METHOD AND APPARATUS FOR MAKING COMPACT PACKAGES FOR SPEADABLE PRODUCT

(76) Inventor: Sanford Redmond, 746 Riverbank Rd., Stamford, CT (US) 09603

( * ) Notice: Subject to any disclaimer, the term of this patent is extended or adjusted under 35 U.S.C. 154(b) by 0 days.

(21) Appl. No.: 09/392,100

(22) Filed: Sep. 8, 1999

Related U.S. Application Data

(60) Provisional application No. 60/099,460, filed on Sep. 8, 1998.

(51) Int. Cl.[7] ..... B65B 11/08

(52) U.S. Cl. ..... 53/519; 53/580; 53/209; 198/803.7; 493/403; 493/435

(58) Field of Search ..... 53/547, 553, 208, 53/209, 452, 457, 519, 580; 198/803.7; 271/204; 493/403, 435

(56) References Cited

U.S. PATENT DOCUMENTS

| | | | | | |
|---|---|---|---|---|---|
| 645,016 | A | * | 3/1900 | Rose | 53/233 |
| 795,949 | A | * | 8/1905 | Wright | 493/161 |
| 1,439,545 | A | * | 12/1922 | Gordon | 493/403 |
| 1,550,033 | A | * | 8/1925 | Lange | 493/403 |
| 2,309,209 | A | * | 1/1943 | Palmer | 53/529 |
| 2,558,368 | A | * | 6/1951 | Maljiot et al. | 53/579 |
| 3,398,660 | A | * | 8/1968 | Watrous | 493/435 |
| 3,917,255 | A | * | 11/1975 | Watrous | 493/403 |
| 4,629,176 | A | * | 12/1986 | Ceelen | 271/204 |
| 4,700,532 | A | * | 10/1987 | Redmond | 53/554 |
| 4,799,664 | A | * | 1/1989 | Burger | 271/204 |
| 5,125,640 | A | * | 6/1992 | Yerly et al. | 271/204 |
| 5,178,262 | A | * | 1/1993 | Merkli et al. | 271/204 |
| 5,191,917 | A | * | 3/1993 | Krumm et al. | 29/230 |
| 5,651,235 | A | * | 7/1997 | Ashley et al. | 53/529 |
| 5,931,459 | A | * | 8/1999 | Landgren | 271/204 |

* cited by examiner

*Primary Examiner*—John Sipos
(74) *Attorney, Agent, or Firm*—Morgan & Finnegan, L.L.P.

(57) ABSTRACT

Method and apparatus for making compact packages for spreadable products involving flights mounted on a conveyor chain having tiny cam operated pivoting clamps which open to precut cards fed in by a card feeder. The pivoting clamps on the flights are opened by cam pressure and pick the cards on the fly as they travel. After passing the end of the cam they close down on the card. The cards are then, after passing over rails with spring resistance members, transported through a unique rotary scoring and bending assembly, which simultaneously scores and bends up longitudinal side flanges to create a channel shaped member from the flat paperboard card.

5 Claims, 15 Drawing Sheets

METHOD AND APPARATUS FOR MAKING COMPACT PACKAGES FOR SPEADABLE PRODUCT

This application claims the benefit of U.S. Provisional Application Ser. No. 60/099,460, filed Sep. 8, 1999 in the name of the Applicant of the instant application, which is hereby incorporated by reference.

BACKGROUND OF THE INVENTION

The present invention relates to the manufacture of a multiplicity of packages for an individual service portion of a spreadable product, and, more specifically, to certain new and useful improvements in the method and apparatus for manufacturing such packages.

The innovation of "compact packages for spreadable products" (trademarked as COMPACT REDDIES™) by this applicant as disclosed in U.S. Pat. Nos. 4,700,532 and 4,720,014 has established the product as a staple package of the United States butter and margerine industry for use by institutions, fast food outlets, hospitals, restaurants, government installations, etc. (Butter will hereinafter be used as the generic term for butter, margerine and all similar spreads).

While this package is about the lowest cost unit of use butter service that is available, it has been competed with by various imitations as well as small individual plastic peel top cups and fully foil wrapped butter pats (or "pats") known to the trade as "Continentals". These cups and "Continientals" have perceive advantage of being sealed or totally enclosed packaging.

OBJECTS OF THE INVENTION

It is an object of the invention to further significantly reduce the materials cost of compact packages for spreadable products.

It is the further object of this invention to create an advanced trouble free manufacturing system and apparatus for the very high speed production of these low cost compact packages (e.g., 1500 units per minute).

The invention consists of the novel parts, constructions, arrangements, combinations, steps and improvements herein shown and described.

SUMMARY OF THE INVENTION

Briefly described, the present invention is directed to a new and improved method and apparatus for making rigid unitized packages formed from channel members unitized by adherence to four sides of the preferably rectangular product encased by the channel members.

In an aspect of the present invention there includes a machine for producing small or compact packages for spreadable products a pat of spreadable product on a flanged paperboard mat covered by a rectangle or sheet of greaseproof paper including a pivotal clamp mechanism actuated by a fixed cam which causes the clamp to pivot open to receive a card or mat and then releases the clamp which snaps on that card. The clamping may be actuated by a leaf spring. The pivoted clamp mechanism and the leaf spring are mounted on a flight comprise a clamping flight assembly which is in turn mounted on a roller chain. The roller chains is mounted with a series of flights carrying the actuated pivoted clamps and are capable of transporting the cards through a driven rotary scoring and tucking assembly which simultaneously scores and bends said cards into a channel shape with upright flanges. The rotary and scoring assembly is comprised of a pair of upper grooved wheels having a tucking step alongside the groove which are driven at the same peripheral velocity that the cards are being transported at by said clamping flight assemblies.

DESCRIPTION OF THE PREFERRED EMBODIMENT

Figure 1:
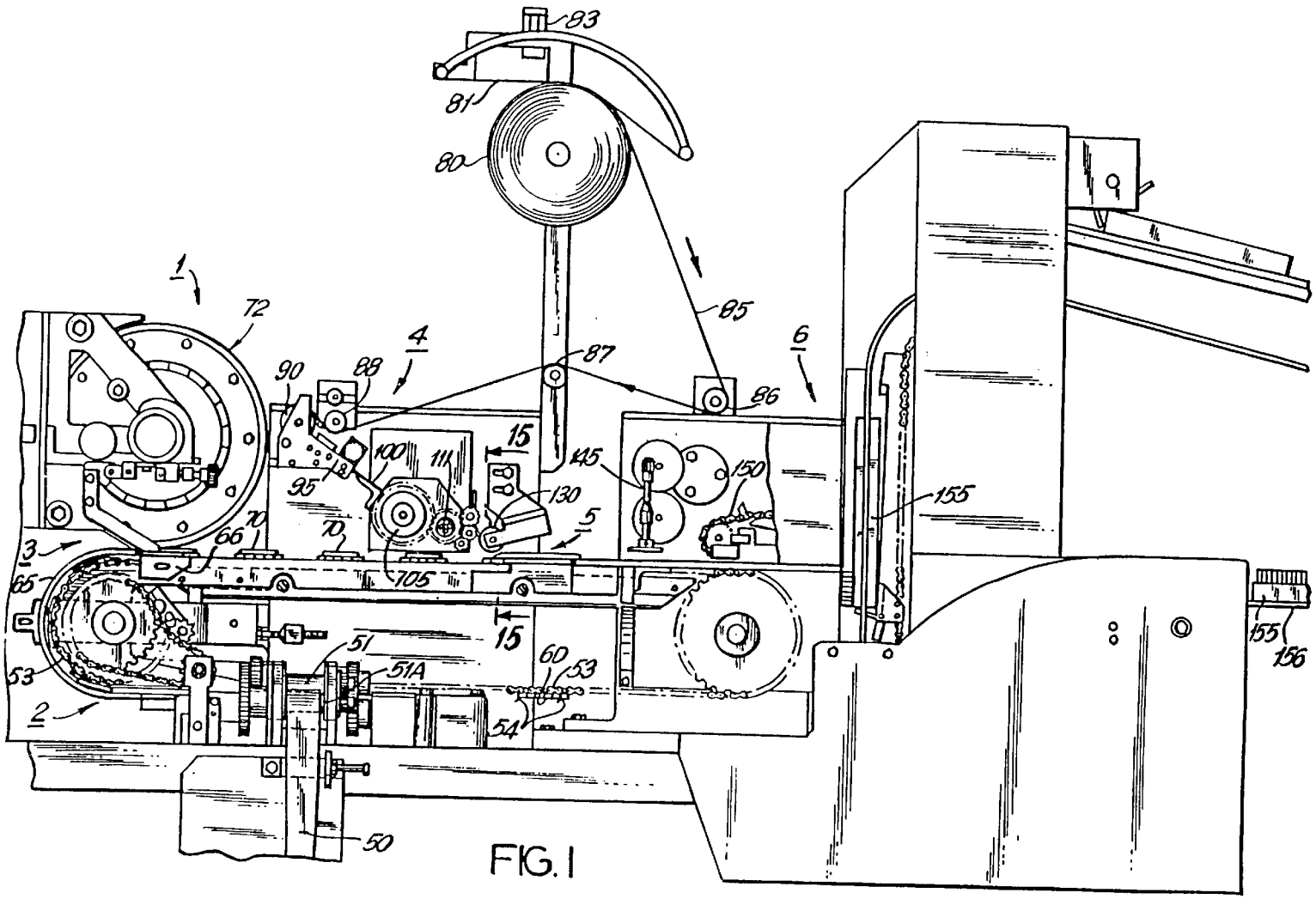
FIG. 1 is a side elevation of a packaging machine construction embodying the present invention.

Referring now more particularly to the preferred embodiment of the invention shown in the accompanying drawings, there is illustrated in FIG. 1 a packaging machine, designated generally by reference number a1, having a bottom channel fabrication section 2, a pat forming and deposition section 3, a cover channel fabrication section 4, a package assembly section 5, and a tray loading section 6.

Bottom Channel Fabrication Section

The bottom channel fabrication section 2 includes a suitable supply (not shown) of a relative stiff paperboard, or other equivalent, material which is drawn from the supply in the form of a web 50 by driven rollers 51, 51A which feed the web of paperboard stock in conventional manner under a rotary cutting roller)(not shown) where the paperboard is cut into individual cards 52 of predetermined length and thereafter accelerated by high speed driven rollers under a conveyor chain 53 moving in a direction perpendicular to the movement of web 50. Advantageously, the aforesaid cutting roller mechanism and high speed accelerating rollers for cutting the paperboard stock and feeding the individual cut cards into the path of the conveyor chain 53 are similar to that shown in FIG. 11, more fully described hereinafter.

Conveyor 53 grips and holds each individual card by a suitable clip member 54 (see FIG. 1A) mounted to each of the conveyor platforms 60 and advances the card through drive scoring rollers 55, 56 and from there to folder/underfolder unit 57.

Figure 15:
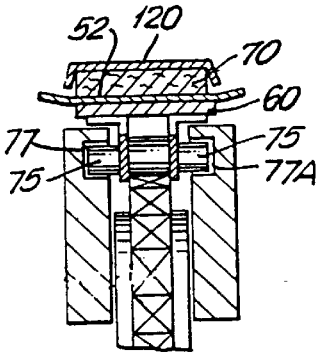
Figure 16:
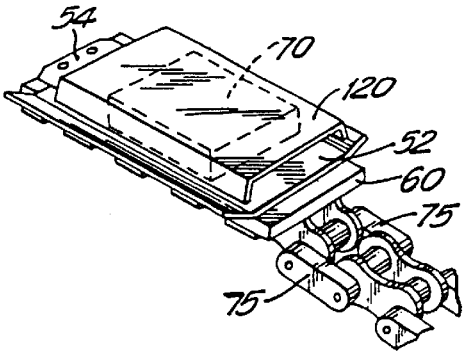
FIG. 16 is a fragmentary perspective view of the conveyor chain shown in FIG. 15.
Figure 17:
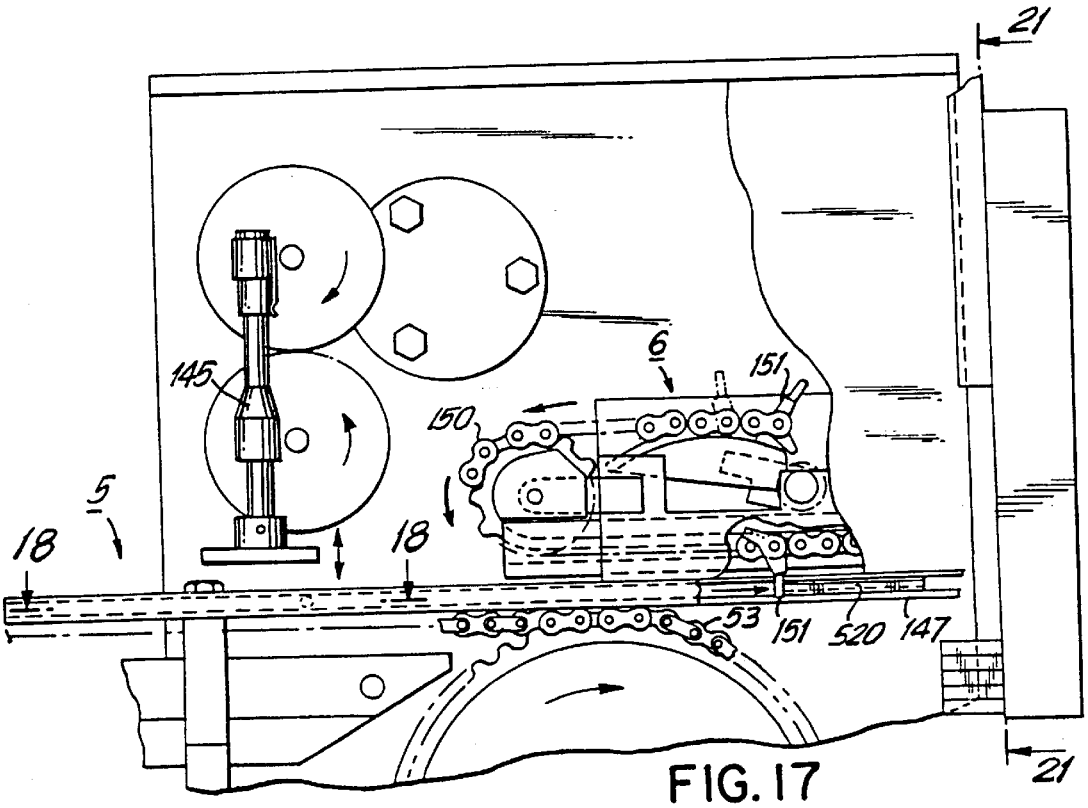
FIG. 17 is a fragmentary view in side elevation illustrating the tamper and tucking rail guide of the package assembly section and the upper accelerating conveyor chain assembly of the tray loading section of the machine shown in FIG. 1.

As best seen in FIGS. 15 and 16, because card 52 is bent into a narrow channel-shaped configuration in the completed package formed by machine 1, conveyor chain 53 and platforms 60 must be even slightly more narrow and it is therefore necessary to provide a guiding system to control the path of travel of the conveyor chain to a straight line with no erratic sidewise or up and down movement. To that end, as here embodied, the conveyor chain links 75 are joined by outer shoe links 76 having flat upper and lower surfaces which are slidably mounted in guide tracks 77, 77A.

Figure 4:
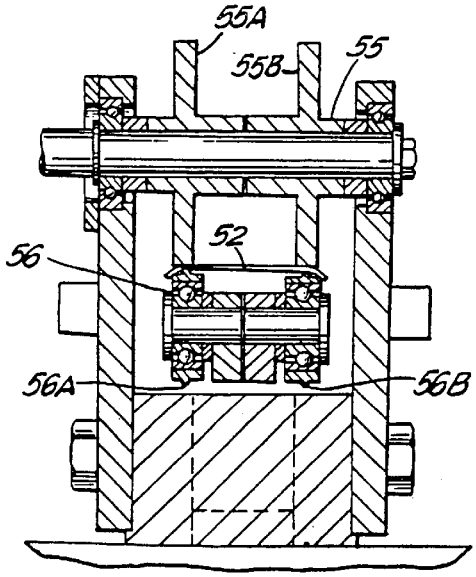
FIG. 4 is a fragmentary sectional view of the driven scoring rollers of the bottom channel fabrication section taken along line 4—4 of FIG. 2, illustrating the scoring of a bottom card cut from the bottom card stock supply.
Figures 5, 5A:
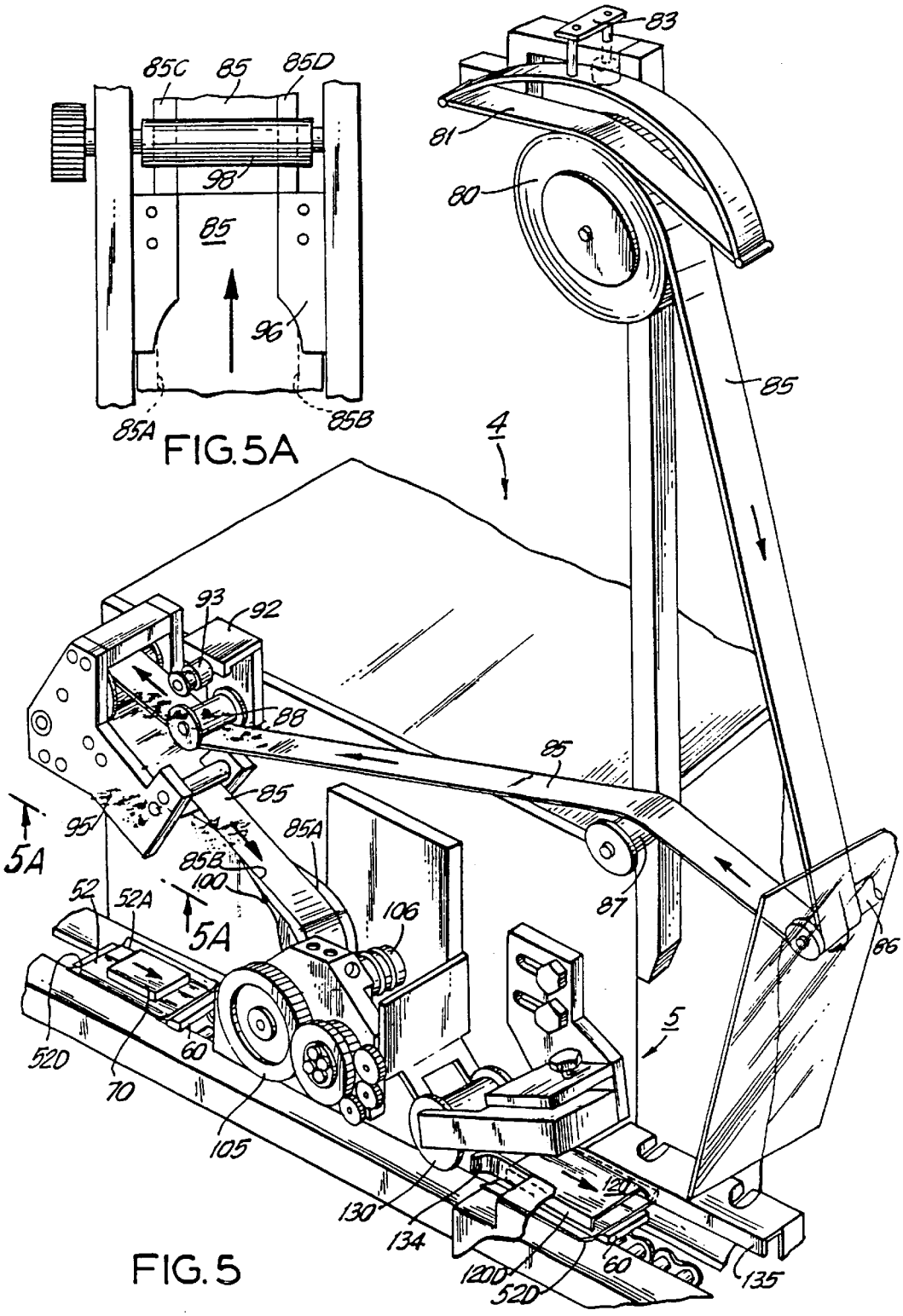
FIG. 5 is an enlarged fragmentary perspective view showing the cover channel fabrication section and a portion of the package assembly section of the package machine shown in FIG. 1.
FIG. 5A is a fragmentary bottom plan view taken along lien 5A—5A of FIG. 5, illustrating the entrance of the top cover material web to the scoring rollers of the cover channel fabrication section.

As here preferably embodied, scoring roller 56 is provided with a pair of raised ribs 56A, 56B which rotate in closely spaced relationship to anvil wheels 55A, 55B of driven roller 55. As best seen in FIG. 4, as conveyor chain 53 (not shown) passes between through anvil wheels 55A, 55B, transporting card 52, card 52 is compressed between ribs 56A, 56B and anvils 55A, 55B, forming a pair of opposed parallel score lines 52A, 52B adjacent two parallel edges of card 52.

It will be seen that by providing driven anvil roller 55 compressing card 52 against scoring roller 56, thus positively gripping and driving card 52 therebetween transported by conveyor chain 53, cards 52 are scored accurately and consistently, ensuring the later formation of the card into a channel which is in true alignment throughout its length. Also, as shown in FIG. 4, ribs 56A, 56B are rounded, or may be otherwise suitably blunted so as to compress, rather than pierce or cut, the paperboard material of the card. It has been found that forming the score in this manner is highly advantageous in preventing moisture or oil contained in the enclosed product from being absorbed into the paperboard.

Figure 2:
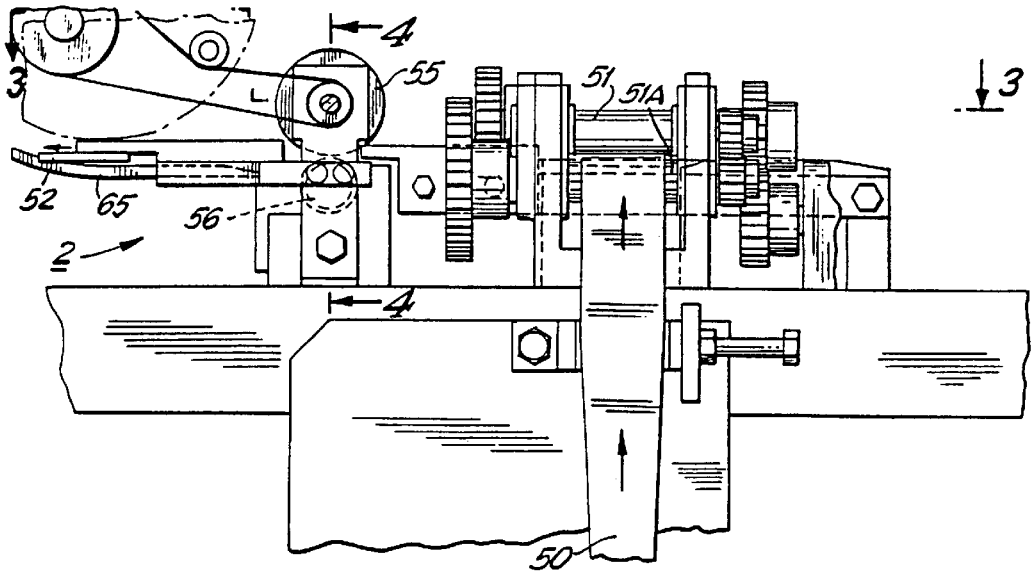
FIG. 2 is a fragmentary view in side elevation of the bottom card feed mechanism and driven scoring rollers of the FIG. 3 is a fragmentary top plan view, partly in section, of the bottom card feed and scoring roller mechanism, taken along line 3—3 of FIG. 2.
Figure 3:
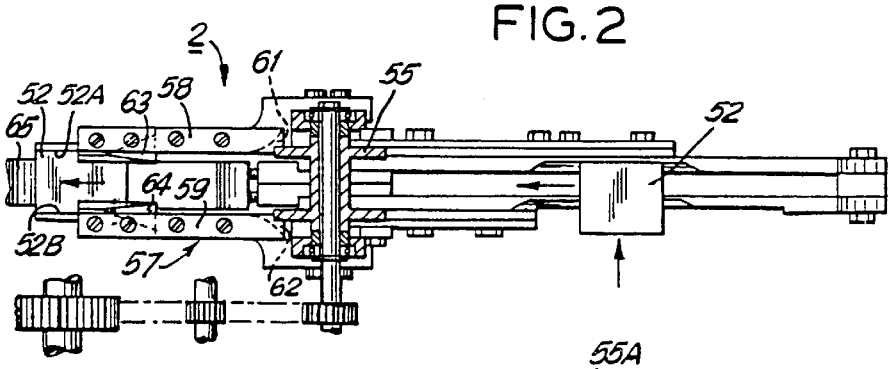

As best seen in FIGS. 2 and 3, folder/unfolder unit 57 comprises a pair of opposed rail members 58, 59 provided with inwardly and downwardly inclined side walls 61, 62 which engage the scored edges of card 52 and bend them gradually downwardly to form card 52 into a channel-lie shape with opposed channel sides 52C, 52D. Advantageously, side walls 61, 62 are inclined to so as to put a radical bend on the scored edges of card 52, preferably well beyond 90°, in order to also ensure that card 52 may be later formed into a true channel and fitted closely about the product to be enclosed, as more fully described hereafter.

As embodied, folder/unfolder unit 57 also includes a second set of upwardly and outwardly inclined side walls 63, 64 which immediately engage and partially re-open the channel sides 52C, 52D of card 52. Alternatively, it has been found that a paperboard material of the thickness desired for card 52 has sufficient stiffness and resiliency to spring back naturally into a partially re-opened position after bending and consequently, that side walls 63, 64 may be optionally omitted with satisfactory results.

Figure 1A:
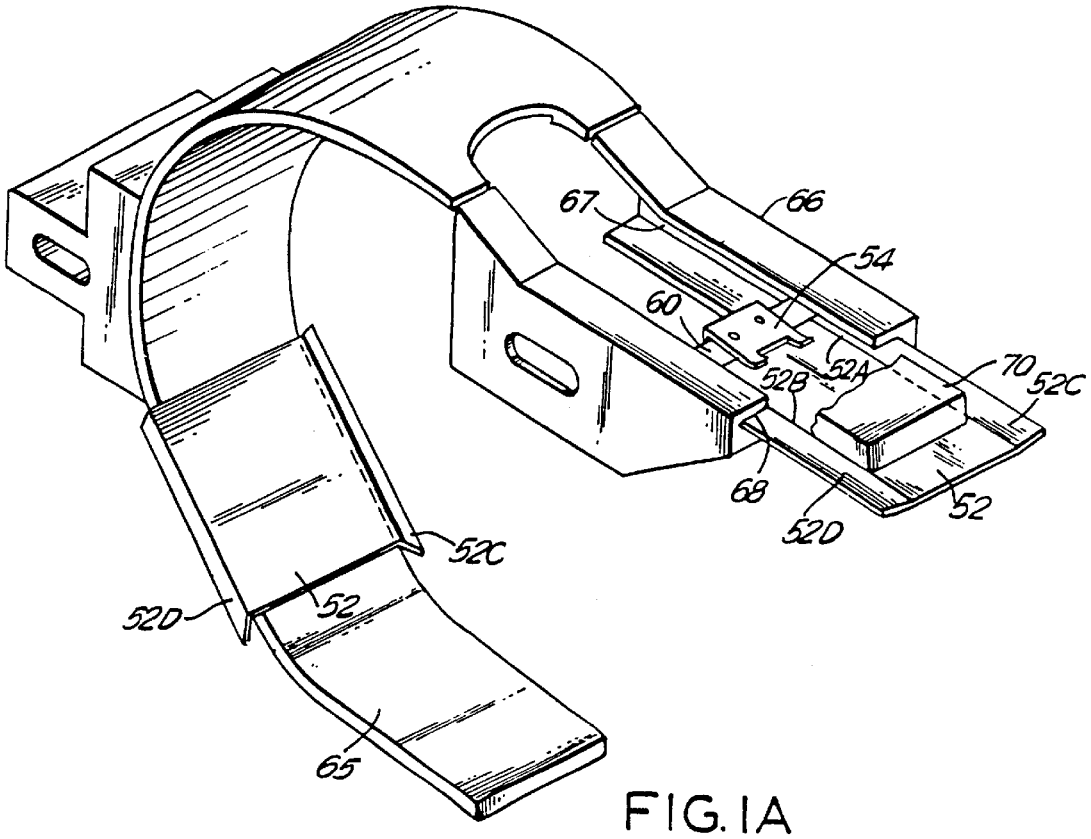
FIG. 1A is an enlarged view in perspective of the bottom card unfolding mechanism of the present invention in which the pre-bent channel-shaped card is reopened and substantially flattened.
Figure 1B:
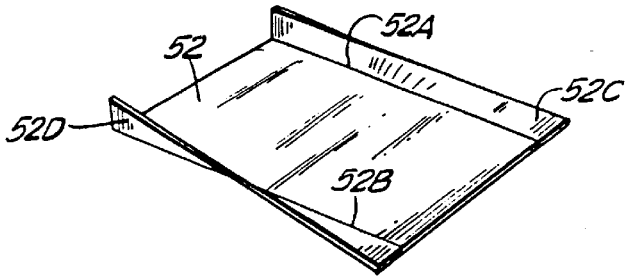
FIG. 1B is an enlarged perspective view of an individual bottom card illustrating the cared in its partially pre-bent channel shape and partially reopened and substantially flattened.

After passing through folder/unfolder unit 57, conveyor 53 carries the pre-scored, pre-bent and partially unfolded card 52 onto a generally semi-circularly shaped guide member 65 mounted circumferentially about the end sprocket gear driving conveyor 53. As best seen in FIGS. 1A and 1B, guide 65 gradually widens to further gradually re-open the previously formed channel sides of card 52 and finally delivers the card into a forming block 66 having opposed guide slots 67, 68 which spread channel sides 52C, 52D of card 52 into a substantially flattened position.

It will be understood from the foregoing that upon passing through forming block 66, the pre-bent and substantially flattened card 52 is ready to receive an individual service portion of a product thereon. Although the present invention is not limited to any particular shape or product material, it is particularly advantageously useful for packaging generally rectangularly-shaped pats of butter or margarine or like product. To that end, for ease of description only, the package formed by the machine and method of the present invention is hereinafter described with reference to a rectangular butter pat but it will be understood the invention is not limited to such usage.

Accordingly, while scored card 52 is being held flat by forming block 66, a rectangularly-shaped pat of butter 70 is advantageously formed and deposited onto the approximate center of card 52 by a suitable forming and feeding drum 72 as is more fully described and illustrated in the aforesaid Redmond U.S. Pat. No. 3,129,546.

Advantageously, and as here preferably embodied, butter pat 70 is shaped and sized so that two opposed sides thereof are aligned with and in close overlying relationship to the score lines 52A, 52B formed in card 52. Card 52 is longer than pat 70 to provide end margins adjacent the sides of pat 70 perpendicular to the sides aligned with the score lines. It will be seen that the provision of end margins serves to both create a neat, elongated appearance to the package and provide a surface for gripping when it is desired to open the package and use the contents thereof Finally, it will be understood from the foregoing that the provision of means for scoring, bending and reopening card 52 into a substantially flattened configuration enables a rectangular pat of butter to be deposited onto card 52 without the numerous difficulties of precise placement that would be required if card 52 was in its channel configuration and yet fit snugly and cleanly within the channel walls when later erected.

After the butter pat 70 is deposited onto the pre-scored card 52, conveyer 53 continues to transport the pat-carrying, pre-scored card 52 toward package assembly section 4.

Cover Channel Fabrication Section

The cover channel fabrication section 4 includes a suitable stock supply 80 of a relatively thin and flexible top cover material 85, preferably paper or a "deadfold" foil, or other equivalent material. Advantageously, conventional roll stock brake means 81 engages roll 80 to control unwinding of material 85 and a suitable switch 83 may be provided to detect when roll 80 is used up and stop the machine for reloading.

Material 85 is continuously drawn from supply roll 80 over a series of flanged idler guide rollers 86, 87, 88 which direct the web of material 85 through a pair of opposed scoring rollers 90, 91 which form a pair of parallel score lines 85A, 85B in material 85 spaced apart a distance approximately equal to score lines 52A, 52B in bottom card 52.

Figure 6:
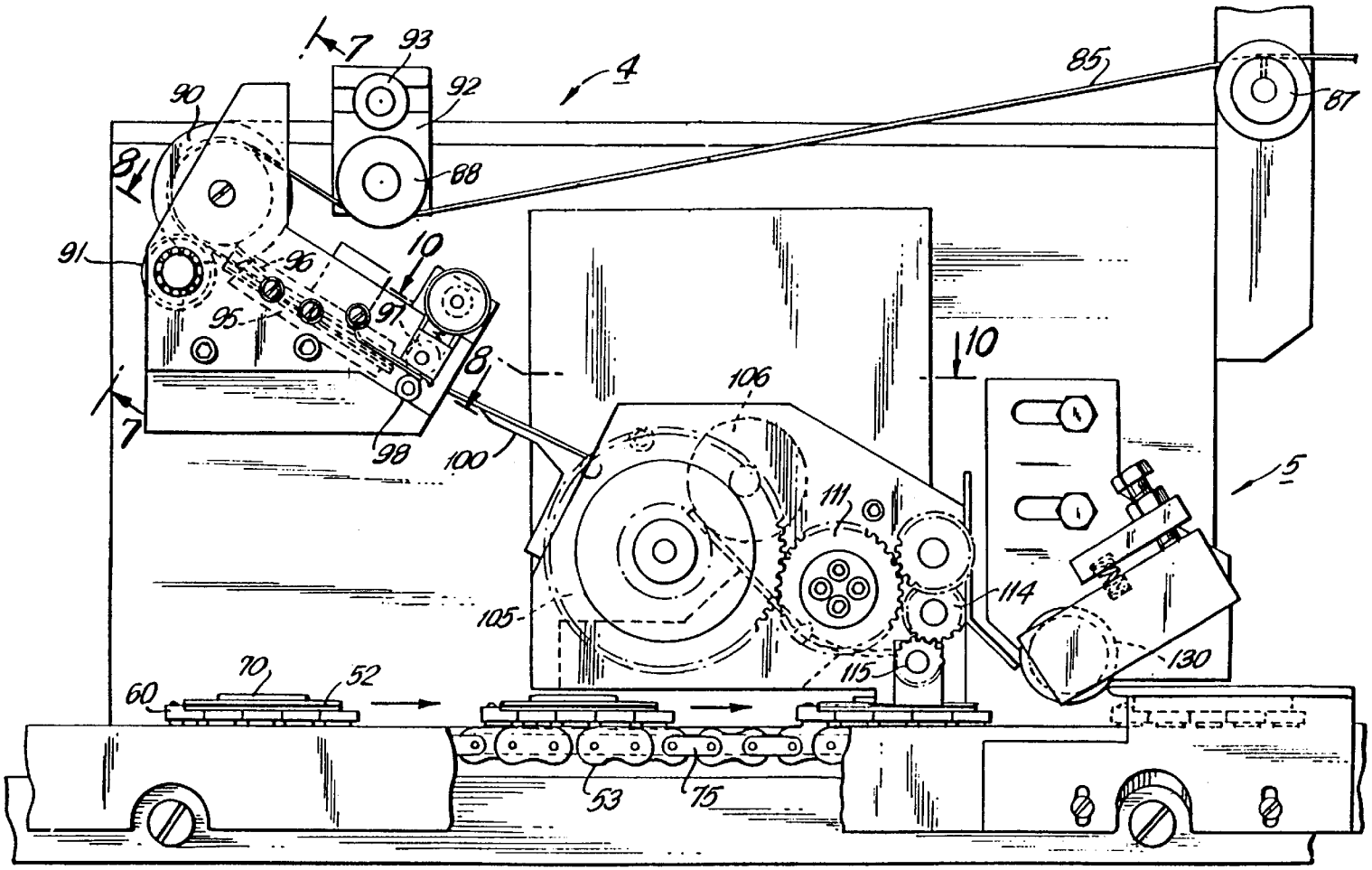
FIG. 6 is a fragmentary view in side elevation illustrating the cover channel fabrication section and a portion of the package assembly section shown in FIG. 5.
Figure 7:
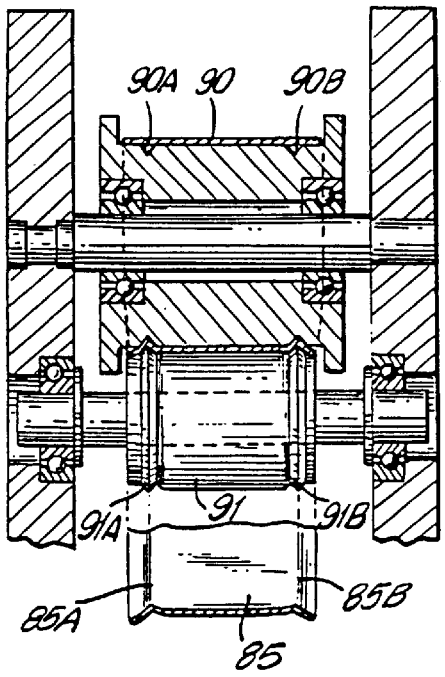
FIG. 7 is a fragmentary sectional view taken along line 7—7 of FIG. 6, illustrating the scoring rollers for the cover channel fabrication section.
Figure 8:
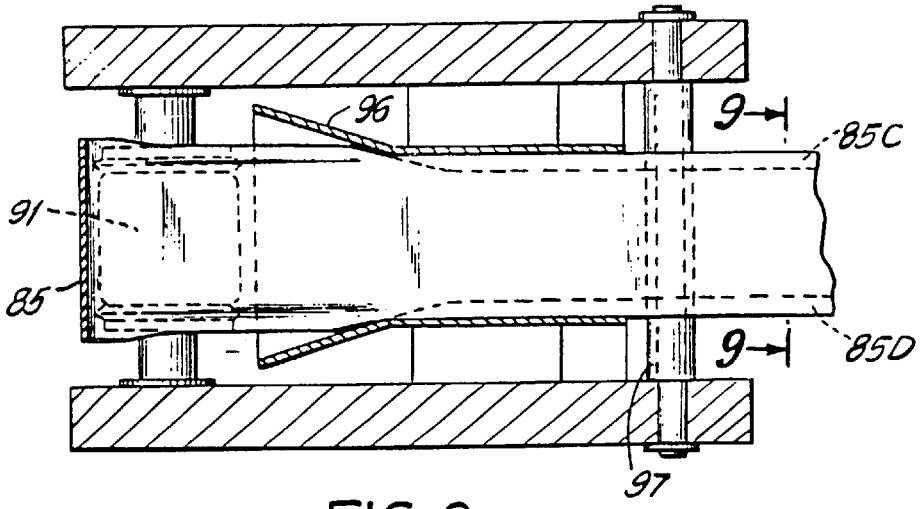
FIG. 8 is a fragmentary top plan view taken along line 8—8 of FIG. 6, showing the folding and creasing unit of the cover channel fabrication section which fold the scored edges of the cover material under the moving material web and compresses the folded edges flat onto the web.
Figure 9:
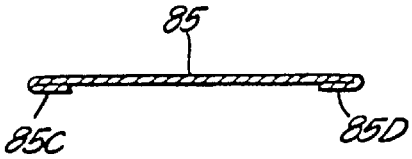
FIG. 9 is a sectional view taken along line 9—9 of FIG. 8, illustrating the scored edges of the cover material folded under and compressed flat onto the material web.
Figure 10:
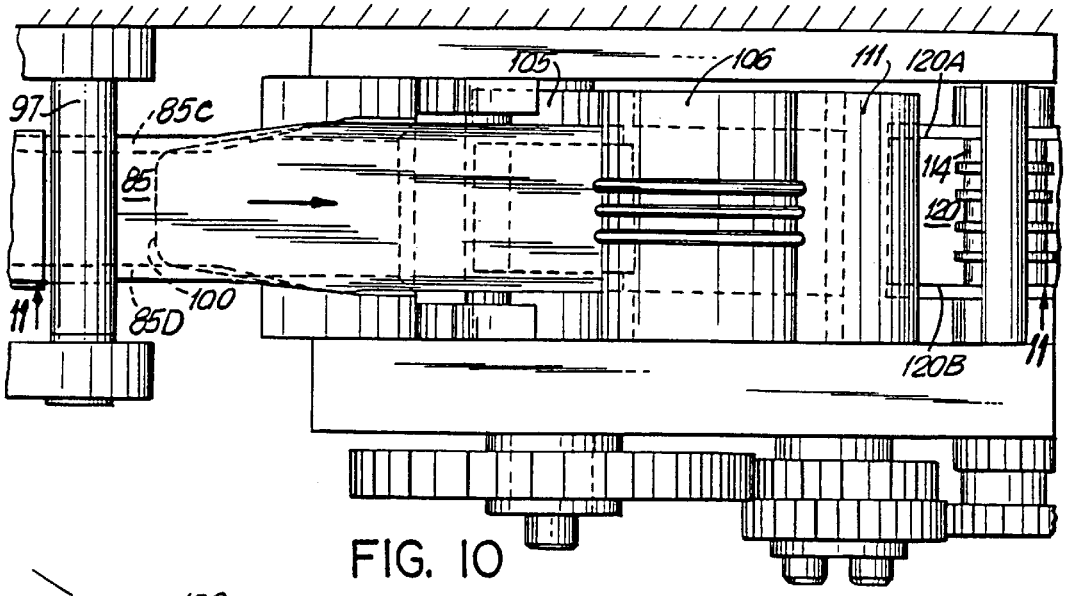
FIG. 10 is a fragmentary top plan view, partly sectional, taken along line 10—10 of FIG. 6, showing draw rollers which draw the web of cover material from the stock supply, the cutting and cover sheet guide unit, and the accelerating rollers which grip and accelerate the cut and pre-creased cover sheet into the package assembly section.
Figure 22:
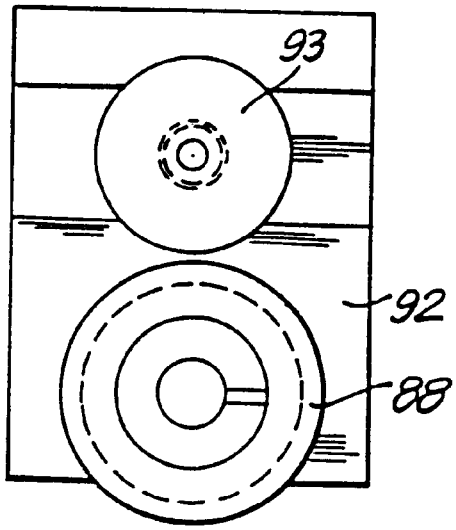
FIG. 22 is an enlarged fragmentary view in end elevation of the cover material web guide roller unit shown in FIG. 1.
Figure 23:
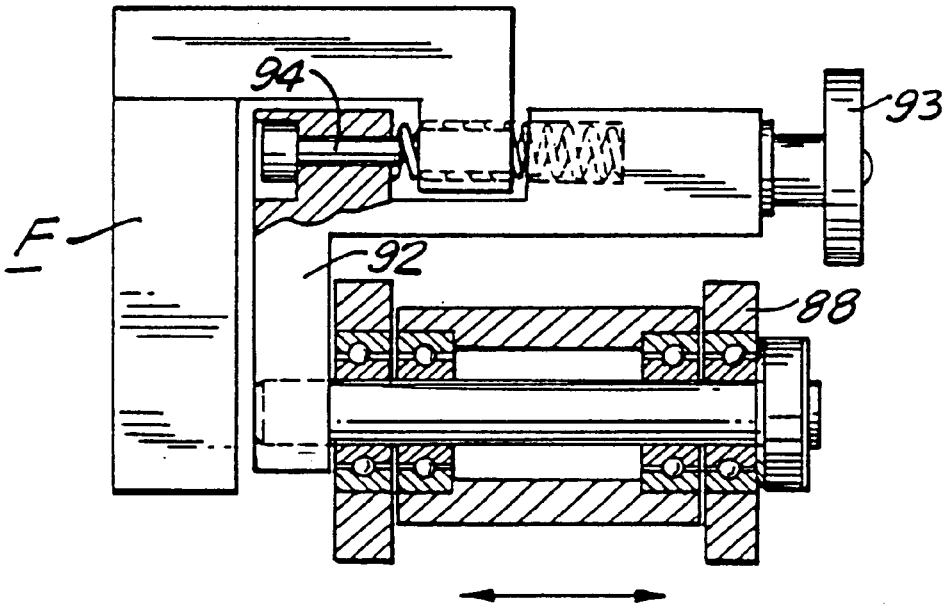
FIG. 23 is a partly sectional, partly elevational view of the web guide unit shown in FIG. 22, the view illustrating the adjustment mechanism for adjusting the lateral position of the flanged web guide roller.

In accordance with the invention, means are provided for guiding material web 85 in accurate alignment through scoring rollers 90, 91. To that end, as here preferably embodied, and as best seen in FIGS. 6 and 22–23, flanged guide roller 88 is rotatably mounted in bracket 92 which in turn is mounted for adjustable movement transversely of web 85 by a threaded knob 93 which forces pin 94 toward or away from the machine frame F.

Scoring rollers 90, 91 are preferably suitably provided with opposed circumferentially extending ridges 90A, 90B in mating relationship to circumferentially extending grooves 91A, 91B, respectively. It will be seen from the foregoing that the provision of aligned and mating ridges and grooves in scoring, rollers 90, 91 results in the formation of ver accurate, consistent, and true score lines in material web 85.

The scored material web 85 is thereafter drawn through a creasing unit 95 including a funnel-shaped former 96 which engages the opposed scored edges 85C, 85D of web 85 and folds them under and back onto web 85 whereupon edges 85C, 85D are compressed flat onto web 85 by opposed pressure adjustable rollers 97, 98. After folding and flattening of edges 85C, 85D, these edges are then passed over a wedge-shaped forming member 100 which again reopens and substantially flattens out edges 85C, 85D into a single plane with web 85, whereupon the pre-creased and substantially flat web 85 passes between the opposed driven draw rollers 105, 106 which grip and pull web 85 from the stock supply 80.

Figure 11:
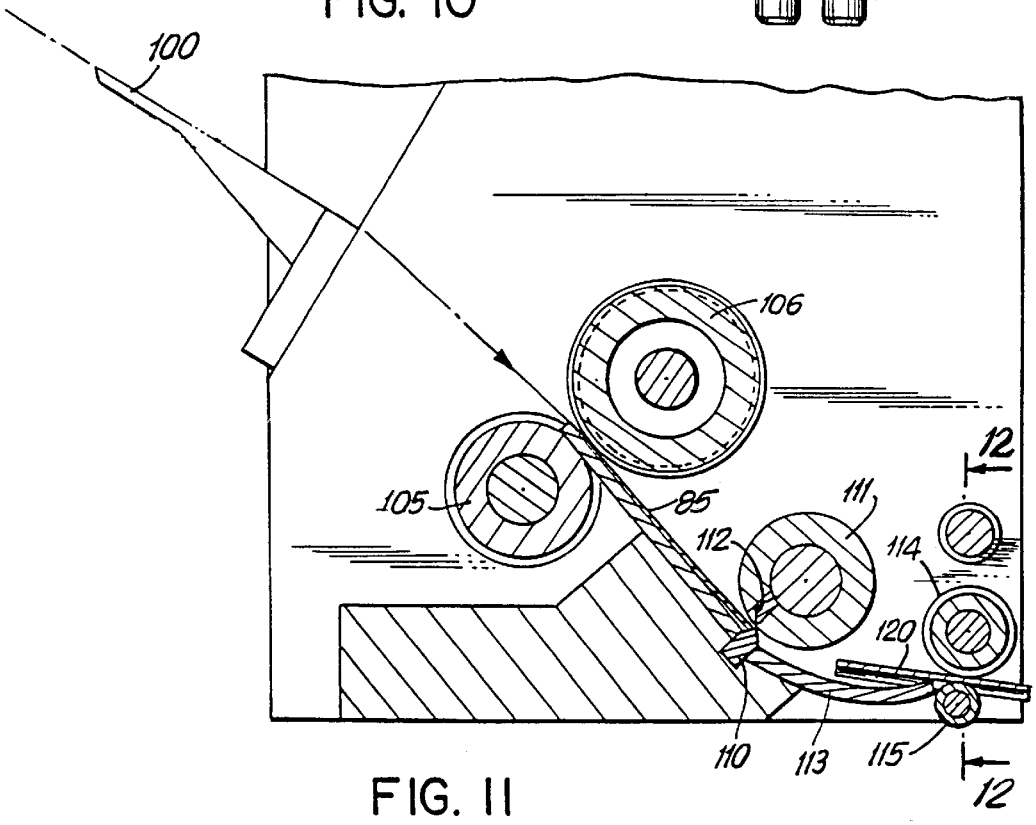
FIG. 11 is a fragmentary sectional view, partly in side elevation, taken along line 11—11 of FIG. 10.
Figure 12:
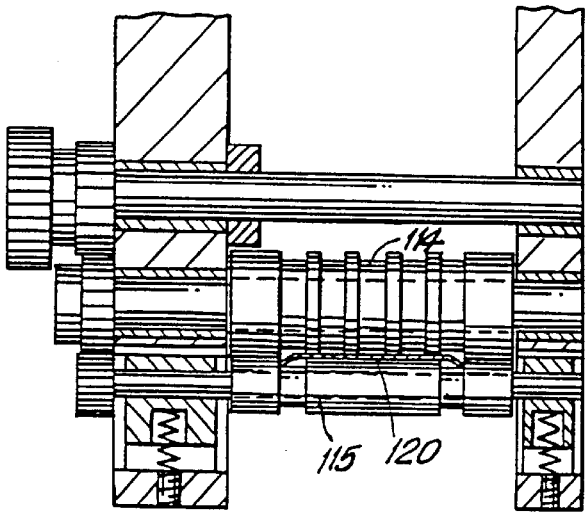
FIG. 12 is a fragmentary view in end elevation, partly in section, taken along line 12—12 of FIG. 11, illustrating an individual pre-creased cover sheet gripped between the high speed driven accelerating rollers of the cover channel fabrication section.

Draw rollers 105, 106 thereafter drive the pre-creased web of cover material 85 through cutting means, which comprise a lower stationary knife blade 110 and an upper driven rotating cutting knife 112 held in adjustably mounted cylinder 111 on its circumferential surface, and web 85 is thereafter directed by guides 113 into engagement with driven high speed accelerating rollers 114, 115. As best shown in FIG. 11, the position and timing of cutting knife 112 is set so that the leading end of web 85 is received between and initially slidingly held by accelerating rollers 114, 115 just prior to the time that blade 112 rotates into cutting position against stationary blade 110. Rotation of blade 112 into contact with blade 110 cuts web 85 into individual pre-creased sheets 120 of predetermined length, preferably approximately equal to the length of bottom card 52, whereupon the cut sheet is instantaneously accelerated forward into the package assembly section 5, where it is deposited onto butter pat 70.

Advantageously, and as will be understood from the foregoing, the relative timing and speed of cutting knife 112 and accelerating rollers 114, 115 are selected so that the individual pre-creased sheets 120 of the top cover material are cut to the desired length and then accelerated forward to a speed coinciding with the speed of travel of the conveyor chain 52 transporting the pre-bent bottom card 52 carrying butter pat 70. Also, as preferably embodied, the aforesaid accelerating movement is of such speed and timing to create a space between successively cut individual top cover sheets 120 which is identical to the space between the transverse center lines of two succeeding bottom cards carried by the conveyor chain 53, to thereby deposit the pre-creased top sheet 120 onto the center of the butter pat 70 carried by the bottom card.

Package Assembly Section

Figure 13:
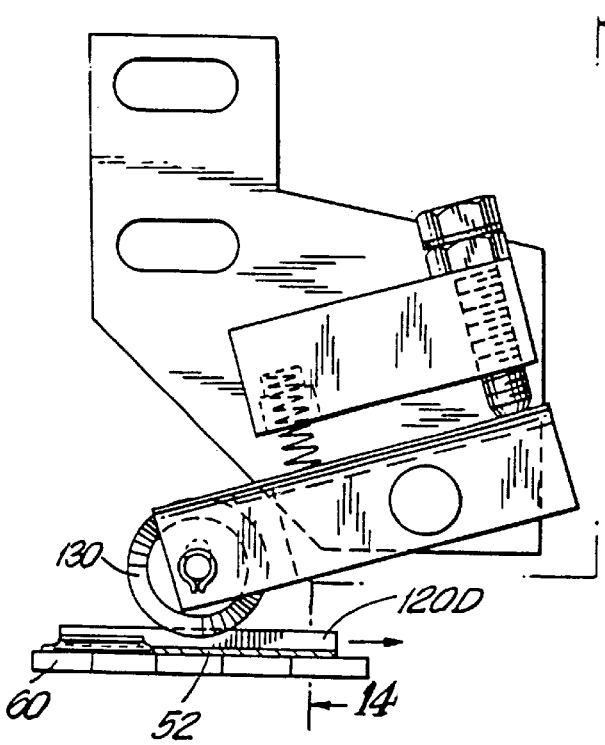
FIG. 13 is an enlarged fragmentary side elevational view of the rolling and tucking spool roller of the package assembly section of the machine shown in FIG. 1.
Figure 14:
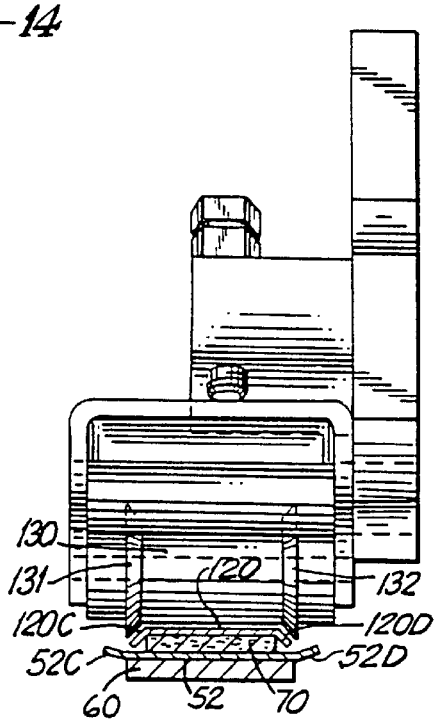
FIG. 14 is a fragmentary view in end elevation taken along line 14—14 of FIG. 13, illustrating the spool roller rolling the cover sheet into adhering contact with the top of the product pat carried by the bottom channel fabrication and package assembly sections.

The package assembly section 5 includes a spring-loaded flanged rolling and tucking spool roller 130 mounted directly above and in alignment with the top of the butter pat 70 being transported beneath roller 130 by conveyor 53. As best seen in FIGS. 13 and 14, the pre-creased cover sheet 120 is rolled into adhering contact with the top surface of butter pat 70 and, simultaneously, the spool flanges 131, 132 of roller 130 bend the pre-creased edges of cover sheet 120 downwardly and closely adjacent to or in partial contact with two opposed sides of butter pat 70, thereby forming cover sheet 120 into a channel-shaped configuration having channel side walls 120C, 120D.

Advantageously, and as here preferably embodied, conveyor 53 thereafter transports card 52 between opposed longitudinally extending card 52 between opposed longitudinally extending side pressure rails 134, 135, preferably shaped similar to the bottom of a ski, which thereafter guide and compress the aforesaid channel sides 120C, 120D of covered sheet 120 against and in generally adhering contact with the sides of butter pat 70.

After the channel-shaped cover sheet 120 is adhered to the top and two opposed sides of butter pat 70, conveyor 53 passes through a pair of opposed longitudinally-extending plow members 138, 139 which raise the pre-scored and pre-bent side edges 52C, 52D of the bottom card 52 into a generally upright position to thereby form channel sides which preferably are in substantially adhering contact, or close-fitting relationship, with the sides of butter pat 70 and also are in overlapping contacting relationship with the outer surfaces of the downwardly extending channel sides 120C, 120D of the top cover sheet 120.

Figure 18:
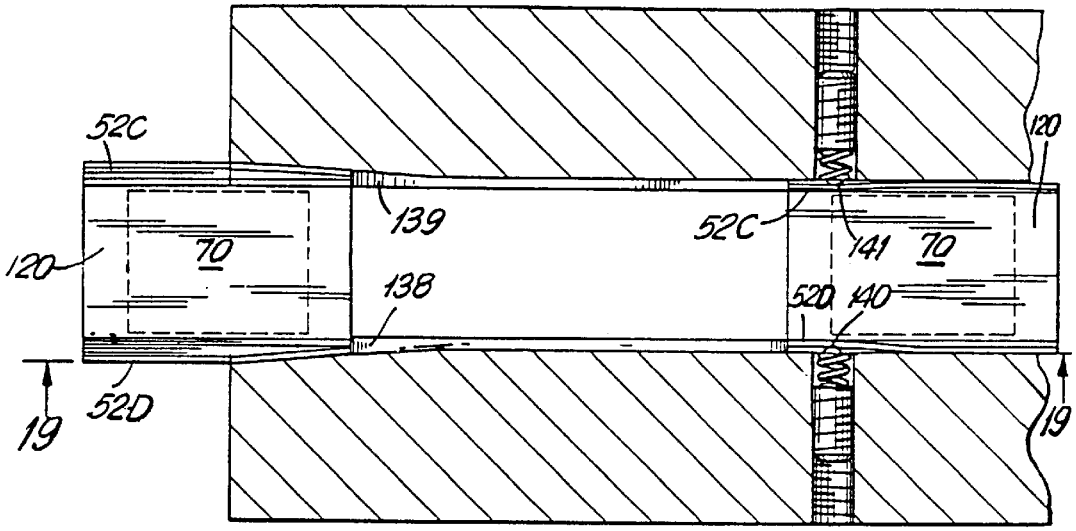
FIG. 18 is a fragmentary top plan view taken along, line 18—18 of FIG. 17, illustrating opposed including plow rails raising the pre-bent sides of the bottom card into a vertical position, thereby forming the bottom card into a channel-shaped configuration, and opposed spring-loaded ball detents pressing the bottom channel sides into adhering contact with the sides of the product and into overlapping contact with the channel sides of the cover channel member adhered to the product.
Figure 19:
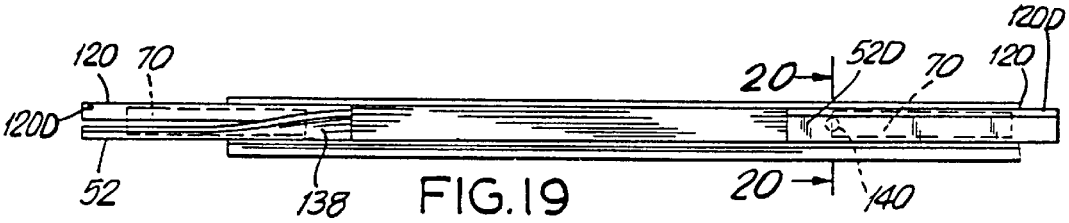
FIG. 19 is a fragmentary view in side elevation taken along line 19—19 of FIG. 18.
Figure 20:
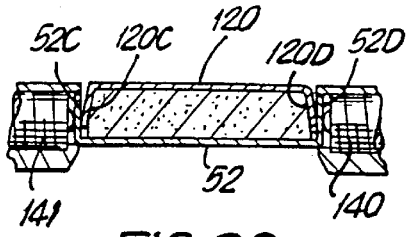
FIG. 20 is a fragmentary sectional view taken along line 20—20 of FIG. 19, illustrating the completed package produced by the machine shown in FIG. 1.
Figure 21:
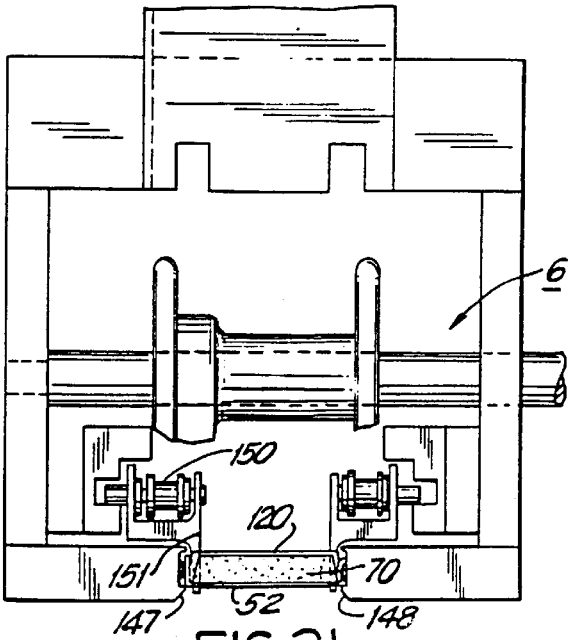
FIG. 21 is a fragmentary view in end elevation taken along line 21—21 of FIG. 17, illustrating an extended finger of the upper conveyor chain assembly of the tray loading section engaging and accelerating a completed package away from the package assembly section and into the tray loading section.

Advantageously, as best seen in FIGS. 18–20, opposed adjustable rail guide means containing spring-loaded detents 140, 141 thereafter press the bottom card channel sides 52C, 52D into generally adhering contact with the lower portion of the sides of the butter pat 70 and into close-fitting overlapping contact with the outer surfaces of the top cover channel sides 120C, 120D.

Finally, as here preferably embodied, immediately following erection of the bottom channel sides 52D, 52D into adhering and overlapping contact with the sides of butter pat 70 and the outer surfaces of cover channel sides 102C, 120D, tamper 145 finally sizes and shapes the completed package. Advantageously, tamper 145 may be constructed as shown and described in the aforesaid Redmond U.S. Pat. No. 4,449,350.

The completed packages in accordance with the invention are thereafter transported and deposited by conveyor 53 onto spaced side rails 147, 148, where they are pushed forward by an overhead conveyor chain assembly 150 having rotatably mounted finger members 151 which engage and accelerate the completed packages away from the package assembly section 4 and into the tray loading section 5.

Tray Loading System

Although not forming a part of the present invention, the completed packages preferably are thereafter suitably transported by conveyor 150 to a tray loading station 5, e.g., as shown and described in my aforesaid U.S. Pat. No. 3,631,652, where they may be advantageously automatically loaded into narrow elongated boxes or trays 155, known as "boats", and the loaded boats automatically transported to a platform or table 56 from which they may be manually placed into shipping containers.

It will be seen from the foregoing general and detailed descriptions that the objects of the invention specifically enumerated herein are accomplished by the invention as here embodied.

Thus, the method and apparatus of the present invention are capable of manufacturing rigid unitized packages enclosing and adhered on four sides to an individual service portion of butter, margarine or similar product at speeds of on the order to 1,500–1,800 packages per minute, and yet the finished packages are of improved quality in appearance and consistency of production. Also, the method and apparatus of the present invention, by prescoring and pre-bending each of the top and bottom channel members forming the package enclosure, produce a finished package having unusually sharply defined corners which give an improved crispness and neatness to the appearance of the package. Pre-scoring and pre-bending of the package components also permits a package to be produced which substantially completely encases the product and yet does not require the use of any external adhesive, thereby further enhancing the speed, efficiency and economy of production of the packages, while reducing materials costs by nearly one-third.

An alternative embodiment as disclosed in FIGS. 24A–27E is now discussed.

The package of U.S. Pat. No. 4,720,014, issued Jan. 19, 1988, hereby incorporated by reference, is comprised of a lower channel member, the mat made of ten millionths of an inch (0.010") thick paperboard made greaseproof and water resistant by various means. A rectangular butter or margerine pat centrally deposited and located between the upright flanges of the channel. Over the pat, a piece of greaseproof paper roughly 3 mils thick folded into an inverted channel whose flanges contact and run down the side of the pat within the upright flanges of the lower ten mil paperboard member. In the United States, the most popular size is 90 pats per pound. These pats contain very close to 5 gms. of product each. Ninety of the mats cost approximately 6 plus cents to as high as 8 cents making them the most expensive single packaging component of compact packages for spreadable products.

A unique new fluorocarbon paperboard coating has been developed by the 3M Corporation (FC-845) which renders it greaseproof and moisture resistant at very low cost. 10 mil. board treated with FC-845 encountered problems in running on the machine of U.S. Pat. No. 4,720,014, issued Jan. 19, 1988, to Redmond, hereby incorporated by reference. It would be advantageous to utilize this paperboard for the mats particularly in reduced gauges, such as 5 mil. which has all the necessary qualities and yields important cost reductions. However, a problem encountered was that the spring steel clips used in the machine to hold the 10 mil. mats while being transported by the conveyor mounted on the conveyor chain as described above damaged the thinner 5 mil. mats and required continual adjustment to make them acceptable.

Therefore, an aspect of the present invention is a system that would not damage the mats since it would open to capture the mat and close to clamp it. This is implemented using a small pivoted clamp (pc) actuated by a fixed cam. Since the machine runs about 25 units per second and the pivoted clamps are very small, bearings could not be reasonably used for the pivot shaft. The pivoted clamp instead may be made of delrin since the delrin would act as its own bearing when drilled for the pivot shaft.

Another problem that was overcome in the present invention is that the system of scoring and bending up the flanges as discussed above was accomplished in two separate operations. A scoring operation followed by a tucking operation where the 5 mil. mats were driven through fixed tuckers which at the high operating speed, often damaged or crumpled the mats. It was discovered by the Applicant while working with this system that the scoring system could be made to both score and bend the system in a single operation which eliminated the need for fixed tuckers of a single power driven rotary system which would both score and bend the paperboard mats in a single operation eliminating the need for fixed tuckers.

These two systems, the cam actuated delrin card clamps and the power driver rotary scorer bender, made feasible the utilization of 5 mil. paperboard mats at the very high operating speeds required.

For even thinner gauges of paper or other materials, the clamps might have to be opened mechanically to release the finished units. When necessary, this can be accomplished by various means such as adding a driven reciprocating tamper which presses on the roller of the delrin pivoted clamp to open it in timed relationships with the removal of the finished package by mechanical means.

Figure 24A:
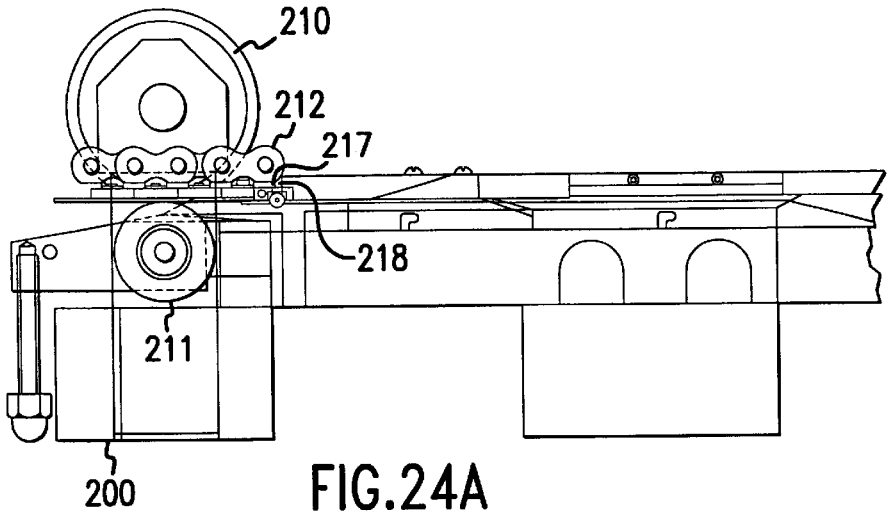
FIGS. 24A–24C disclose various views of the scorer-bender assembly with the pivoting clamp assemblies of an alternative embodiment.
Figure 24B:
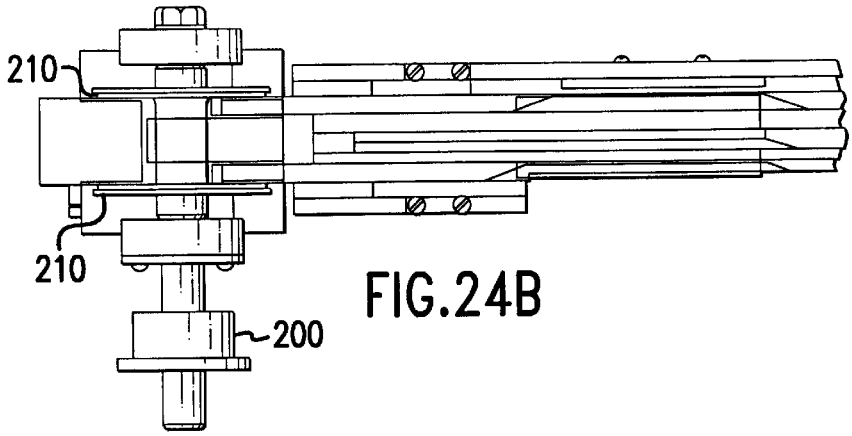
Figure 24C:
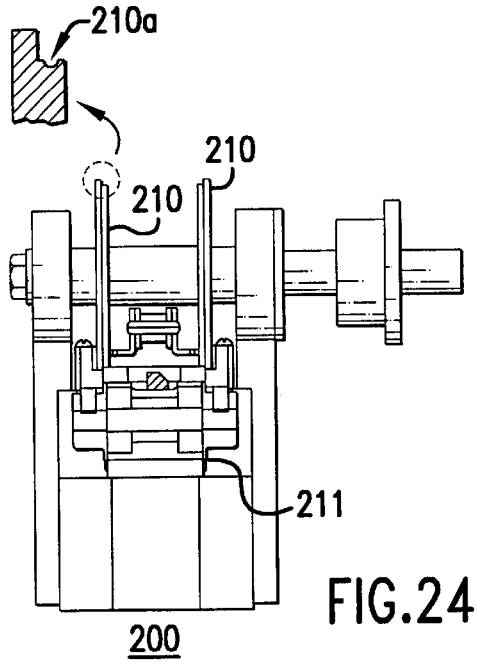

FIGS. 24A–24C disclose various views of the scorer-bender assembly 200 with the pivoting clamp assembly 217 according to the present invention. The scorer-bender assembly is comprised of a pair of upper grooved roller dies 210 with outer flanges which in cooperation with a pair of lower thin flanged roller dies 211 create a score and simultaneously bend a pair of edge flanges in the mat member. Also shown is a conveyor chain 212 which conveys the mat through the machine. Flights 217 are mounted on the conveyor chain 212 and includes tiny cam operated pivoting clamps 218 which open to precut cards or mats fed in by a card feeder. The pivoting clamps 218 on the flights 217 are opened by cam pressure and pick the cards or mats on the fly as they travel. After passing the end of the cam they instantly close down on the card actuated by a stainless steal leaf spring 231. The cards are then, after passing over rails with spring resistance members, transported through the unique rotary scoring and bending assembly of the present invention which simultaneously scores and bends up longitudinal side flanges to create a channel shaped member from the flat paperboard card.

Figure 25:
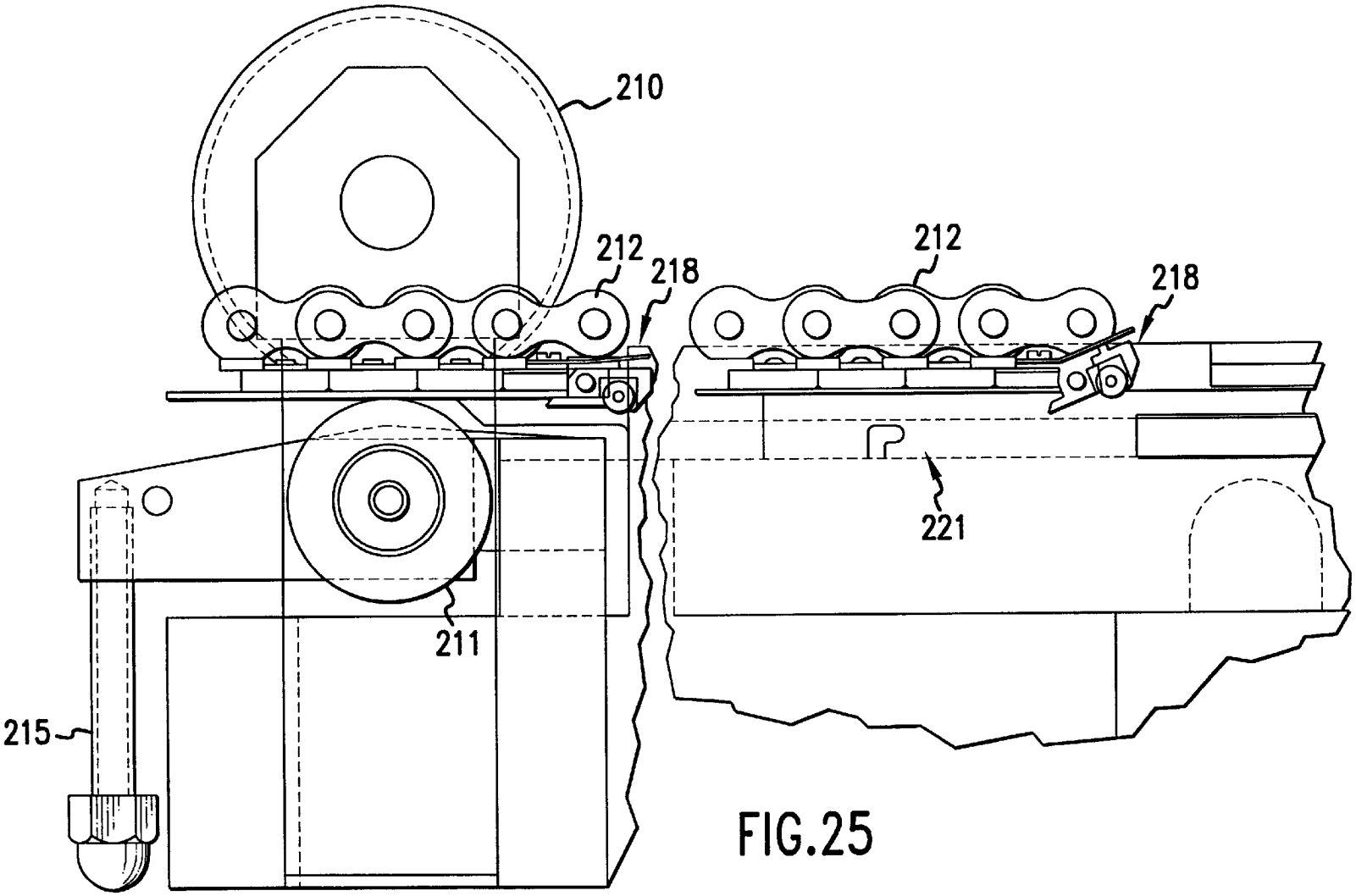
FIG. 25 is a side elevation view of the scorer-bender assembly with the pivoting clamp assemblies of the alternative embodiment.

FIG. 25 illustrates a side elevation view of the scorer-assembly and pivoting clamps 218 of the present invention. Reference numeral 215 shows a score depth adjuster for optimizing the scoring. Pivoting clamps 218 are shown in both an open position and a closed position. Reference numeral 221 illustrates a flight opening cam which periodically opens and closes pivoting clamps 218.

Figure 26A:
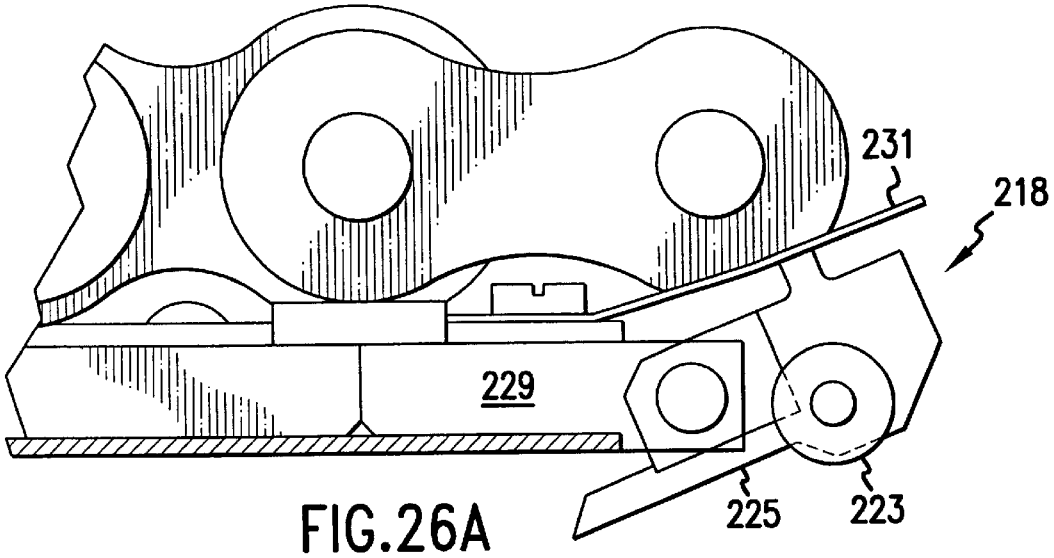
FIGS. 26A–26B are enlarged views of a pivotal clamp assembly.
Figure 26B:
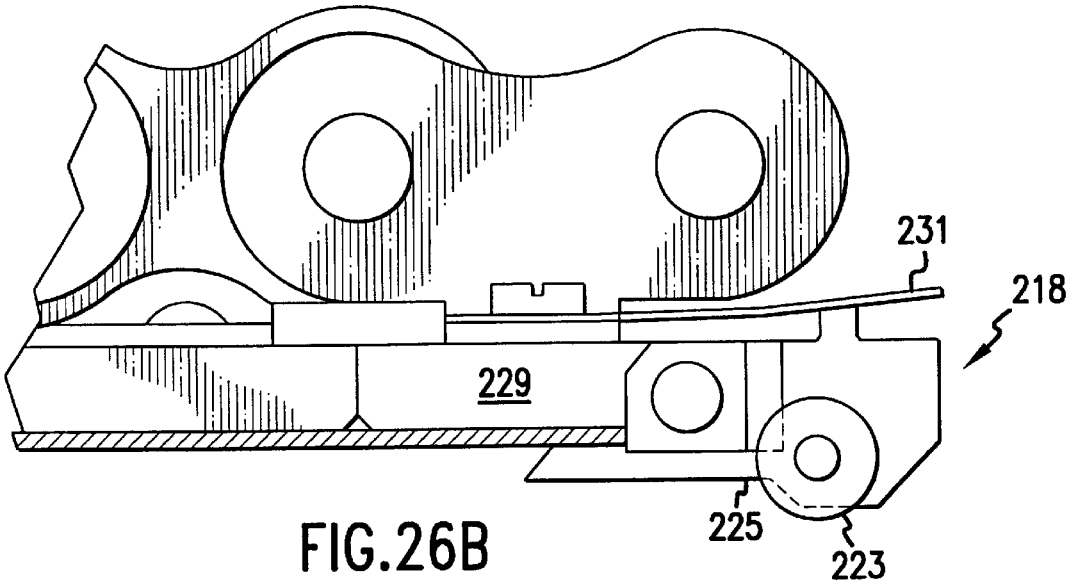
Figure 27A:
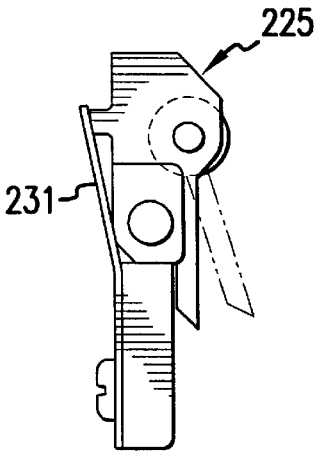
FIGS. 27A–27E show various elements of the clamp assembly.
Figure 27B:
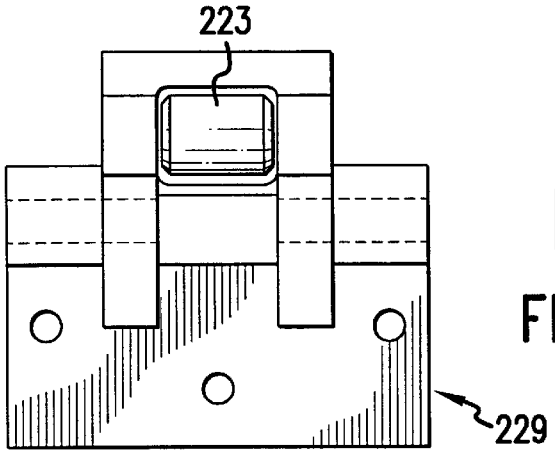
Figure 27C:
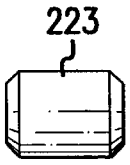
Figure 27D:
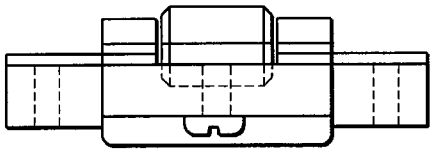
Figure 27E:
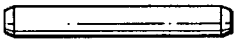

FIGS 26A–26B illustrate a detailed view of a pivoting clamp assembly 217. FIG. 26A shows the pivoted delrin clamp assembly 218 in open position for engaging or releasing mat 227 and FIG. 26B shows the pivoted delrin clamp assembly 218 clamping mat 227 in a closed position. Reference numeral 223 indicates a cam follower roller and reference numeral 225 indicates a delrin clamp member. Reference numeral 229 indicates a stainless steel flight body and reference numeral 231 indicates the leaf spring. FIGS. 27A–27E show the elements of the delrin clamp assembly 218 in detail.

A method of operation of the alternative embodiment is discussed. A card receiving and conveying pivotal clamp assembly 218 is mounted on a flight 217 which in turn is mounted on the roller chain 212. The roller chain 212 is mounted on a series of the flights 217 which carry the actuated pivoted clamps 218. The pivoting clamps 218 are actuated by fixed cams which cause the clamps 218 to pivot open to receive cards or mats 227. The cams then release and the clamps 218 are actuated by leaf springs 231 which then snap shut on the cards 227.

The roller chain 212 is capable of transporting the cards 227 through the driven rotary scoring and tucking assembly 200 which simultaneously scores and bends the cards into a channel shape with upright flanges. The rotary scoring and tucking assembly 200 is comprised of a pair of upper grooved wheels 210 having a tucking step alongside the groove 210*a* (shown in FIG. 24C). The upper grooved wheels are driven at the same peripheral velocity that the cards are being transported at by the clamping assemblies 218.

More specifically, this embodiment discloses a new system for handling paperboard or mat in a variety of gauges ranging from 0.010" and more to 0.004 inches thick and less.

The invention in its broader aspects is not limited to the specific embodiments herein shown and described but departures may be made therefrom within the scope of the accompanying claims, without departing from the principles of the invention and without sacrificing its chief advantages.

What is claimed is:

1. A machine for producing packages of spreadable products comprising:

a single roller chain having at least one flight assembly for scooping up, clamping, and driving a card member ahead of it mounted thereon comprising a flight body, a centrally pivoted clamp member pivoting in a see-saw manner on a first shaft held in place at each of its ends by said flight body, said at least one flight assembly including a flat spring for driving, in a see-saw manner and holding, said centrally pivoted clamp member in a given direction to a first and clamping position and a cam follower roller mounted on a second shaft mounted in said centrally pivoted clamp member to drive, by means of a fixed cam, said centrally pivoted clamp member in a reverse see-saw manner opposing the force of said spring to rapidly pivot said clamp member to a second and open position to scoop up the card by said clamp member.

2. The machine of claim 1, wherein said clamp member of said at least one flight assembly is in said first clamping position as it drives the card through a pair of scorer-bender wheels which simultaneously score and bend flanges parallel to both side edges of the card.

3. The machine of claim 2, wherein said pair of scorer-bender wheels include a pair of driven grooved wheels having bending steps mating with a pair of scoring wheels that drive the card member into grooves of said grooved wheels for creating a pair of parallel scores in the card member spaced apart a distance approximately equal to a width of the spreadable product to be deposited thereon and for bending the card member at the parallel scores to form the card member into a channel having flanges to receive a spreadable product.

4. The machine of claim 1, further comprising a driven scoring and bending assembly for scoring and bending the card member into a channel having flanges.

5. The machine of claim 4, wherein said scoring and bending assembly includes a pair of grooved wheels each having a bending step, and in addition a pair of scoring rollers to drive the card member into grooves of said pair of grooved wheels to create score lines on the card member while said bending steps bend the card member at the score lines to form the channel flanges.

* * * * *